US007938259B2

(12) United States Patent
Conklin et al.

(10) Patent No.: US 7,938,259 B2
(45) Date of Patent: May 10, 2011

(54) DISPLAY CONTAINER

(75) Inventors: Christopher Conklin, Beaverton, OR (US); Michelle Deaton, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 215 days.

(21) Appl. No.: 11/759,844

(22) Filed: Jun. 7, 2007

(65) Prior Publication Data

US 2008/0047858 A1 Feb. 28, 2008

Related U.S. Application Data

(60) Provisional application No. 60/812,200, filed on Jun. 9, 2006.

(51) Int. Cl.
*B65D 85/00* (2006.01)
*B65D 25/54* (2006.01)

(52) U.S. Cl. ..... 206/315.9; 206/769; 206/782; 206/783; 229/162.1; 229/162.6

(58) Field of Classification Search ..... 206/315.9, 206/779, 780, 782, 783, 733, 763, 769, 771, 206/775; 229/103.3, 162.1, 162.6
See application file for complete search history.

(56) References Cited

U.S. PATENT DOCUMENTS 2,205,341 A * 6/1940 Brogden ..... 229/125.38
3,337,033 A * 8/1967 Cote ..... 206/418
3,455,498 A * 7/1969 Gadiel ..... 229/117
3,539,091 A * 11/1970 Murray ..... 206/418
3,734,397 A * 5/1973 Cote ..... 206/418
3,987,893 A * 10/1976 Hanson ..... 206/779
4,162,008 A * 7/1979 McCalmont ..... 206/590
4,194,679 A 3/1980 Lohrbach et al.
4,452,355 A * 6/1984 Benham ..... 206/315.9
4,717,022 A * 1/1988 Combs ..... 206/418
5,139,196 A 8/1992 Fry et al.
5,881,885 A * 3/1999 Grimm ..... 206/779
6,036,010 A 3/2000 Seyffert et al.
6,199,692 B1 * 3/2001 Van Ness et al. ..... 206/315.9

(Continued)

FOREIGN PATENT DOCUMENTS

BE 514412 10/1952

(Continued)

OTHER PUBLICATIONS

International Preliminary Report on Patentability for International Application No. PCT/US2007/013704, mailed Dec. 24, 2008, 12 pages.

(Continued)

*Primary Examiner* — Mickey Yu
*Assistant Examiner* — Sharon M Prange
(74) *Attorney, Agent, or Firm* — Banner & Witcoff, Ltd.

(57) ABSTRACT

A structure configurable for holding and displaying a product (e.g., a game ball or sporting equipment) may include one or more sides having an aperture through which the contained product is visible. One or more sides of the structure may include flaps that are flexible inward toward an interior of the structure. The flaps may include a protrusion configured to contact and hold the product contained in the structure. A first flap may further include slits for receiving portions of a second flap to form a side of the structure. One or more sides of the structure may be void of an aperture to provide a surface on which information about the product may be displayed.

8 Claims, 20 Drawing Sheets

U.S. PATENT DOCUMENTS

| | | | | |
|---|---|---|---|---|
| 6,568,528 | B2 * | 5/2003 | Murray | 206/315.9 |
| 6,644,473 | B2 * | 11/2003 | Kohler | 206/315.9 |
| D532,686 | S * | 11/2006 | Wijerama | D9/418 |
| 2004/0069842 | A1 | 4/2004 | Boutin | |

FOREIGN PATENT DOCUMENTS

| | | |
|---|---|---|
| GB | 206764 | 11/1923 |
| GB | 1222549 | 2/1971 |
| GB | 2202205 | 9/1988 |

OTHER PUBLICATIONS

International Search Report and Written Opinion for International Application No. PCT/US2007/013704, mailed Mar. 13, 2008, 18 pages.

Communication pursuant to Article 94(3) EPC, for Application No. 07809461.2, mailed Aug. 20, 2009, 3 pages.

European search Report issued for counterpart European Application No. 10176659, mailed Oct. 27, 2010.

* cited by examiner

DISPLAY CONTAINER

BACKGROUND

Many athletic activities, particularly team sports, utilize one of a variety of game ball types. For example, the game of soccer utilizes a soccerball, whereas the game of basketball utilizes a basketball. Other types of game balls that are commonly utilized include footballs, volleyballs, baseballs, and softballs, for example. The suitability of a type of game ball for a particular athletic activity depends upon a variety of characteristics, including dimensions, shape, materials, and weight.

When purchasing game balls, consumers generally prefer to inspect the game balls, which may include both a visual inspection and a tactile inspection (i.e., through touch) to ensure that the game balls possess the requisite characteristics. Moreover, inspection of the game balls permits the consumers to verify whether the game balls possess a requisite degree of quality, which is dependent upon workmanship and materials. Packaging, such a conventional box, may inhibit consumers' ability to inspect game balls. Accordingly, many manufacturers transport game balls to retail locations without packaging, and the game balls are displayed in bulk at the retail locations in a large bin or basket.

One drawback to displaying game balls without packaging is that information regarding the game balls may not be provided to the consumers. For example, when game balls are loosely displayed in a large bin or basket, information on materials used in the game balls, specifications of the game ball, and approval from governing athletic organizations may not be coupled with the game balls for use by the consumers when selecting between models or manufacturers. Another drawback relates to protection of the game balls. That is, damage to the game balls may occur during transport or while on display at the retail location.

SUMMARY

A container for receiving and displaying a game ball or a variety of other products is disclosed. The container may permit consumers to inspect a game ball by exposing a significant area of the game ball. The container may also provide an area for information on the game ball to be displayed, thereby providing the information to the consumers at a retail location. In addition, the container may impart protection to the game ball during transport and at the retail location.

The container may include various flaps with protrusions shaped to have a curvature that is approximately equal to the curvature of the game ball. In addition to supporting the game ball, the protrusions may contact the surface of the game ball along substantially all of the length of the protrusions. This configuration limits the degree to which the game ball rotates or otherwise moves during transport. In addition, the flaps of the container may have other protrusions and slits that mate and interlock to join the flaps together. In this configuration, the flaps may be folded inward to interlock the flaps and complete assembly of the container. Similarly, the flaps may be pressed further inward to disengage the protrusions and slits for purposes of removing the game ball from the container.

To gain an improved understanding of the advantages and features of novelty reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose a container 10 for receiving and displaying a game ball. Although container 10 is depicted in combination with a soccerball 100 in FIGS. 1-5, other configurations of container 10 may be utilized to receive and display a variety of other game balls, including a basketball, volleyball, football, baseball, or softball, for example. Container 10 may also be utilized to receive and display a variety of other products, in addition to game balls. Accordingly, container 10 is disclosed in a configuration suitable for receiving and displaying soccerball 100 for purposes of example, and may also be utilized to receive and display a variety of other products.

As discussed in the Background section above, packaging for game balls may inhibit the consumers' ability to inspect game balls. Furthermore, loosely displaying game balls without packaging limits the ability of manufacturers to convey information regarding the game balls to the consumers, and loosely displaying game balls may not provide adequate protection to the game balls. Container 10, however, permits consumers to properly inspect soccerball 100 by exposing a significant area of soccerball 100. Container 10 also provides an area for information on soccerball 100 to be displayed, thereby providing the information to the consumers. In addition, container 10 imparts protection to soccerball 100 during transport and at a retail location.

Figure 1:
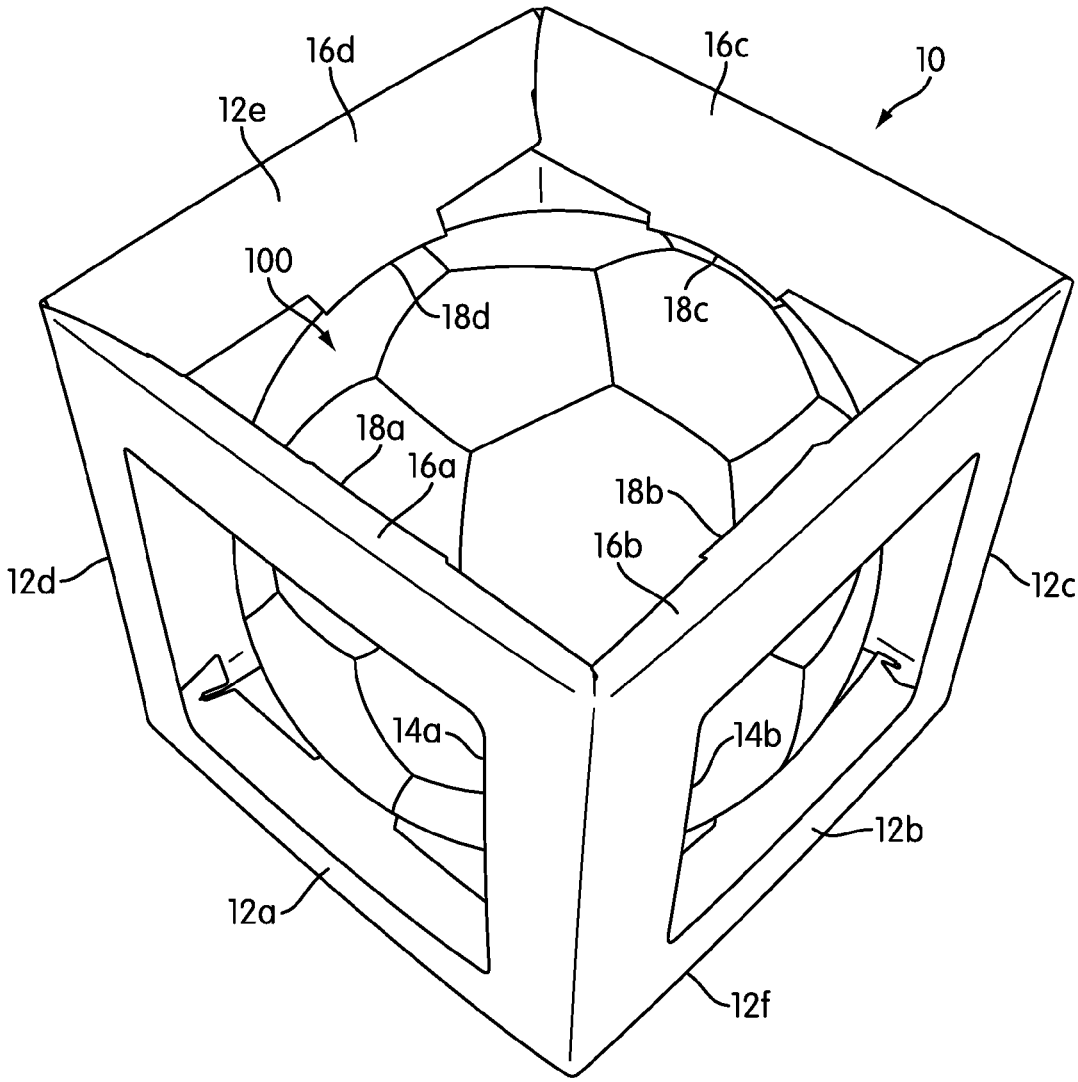
FIG. 1 is a perspective view of a first display container in a closed configuration and in combination with a game ball.
Figure 2:
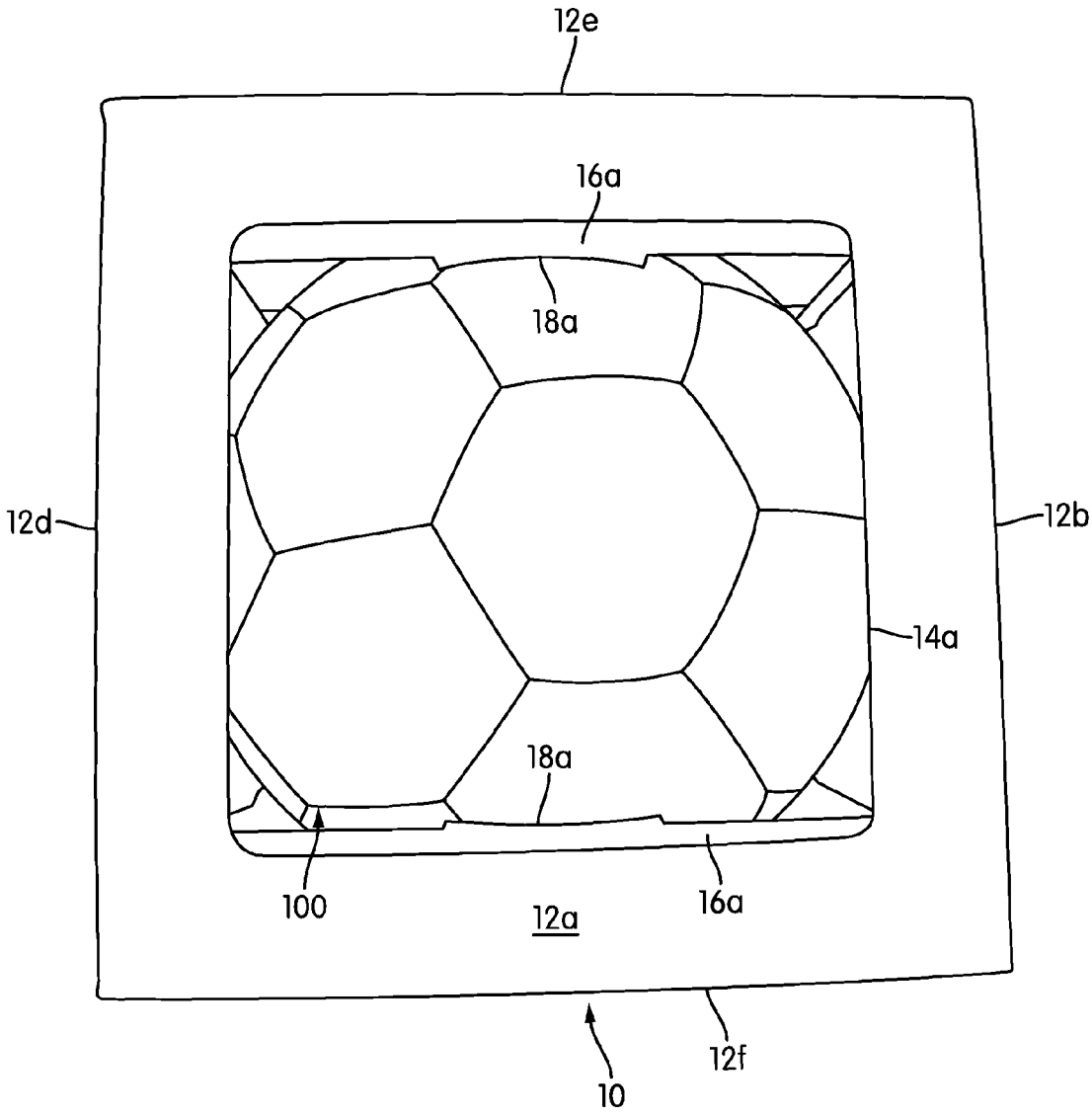
FIGS. 2 and 3 are side elevational views of the first display container in the closed configuration and in combination with the game ball.
Figure 3:
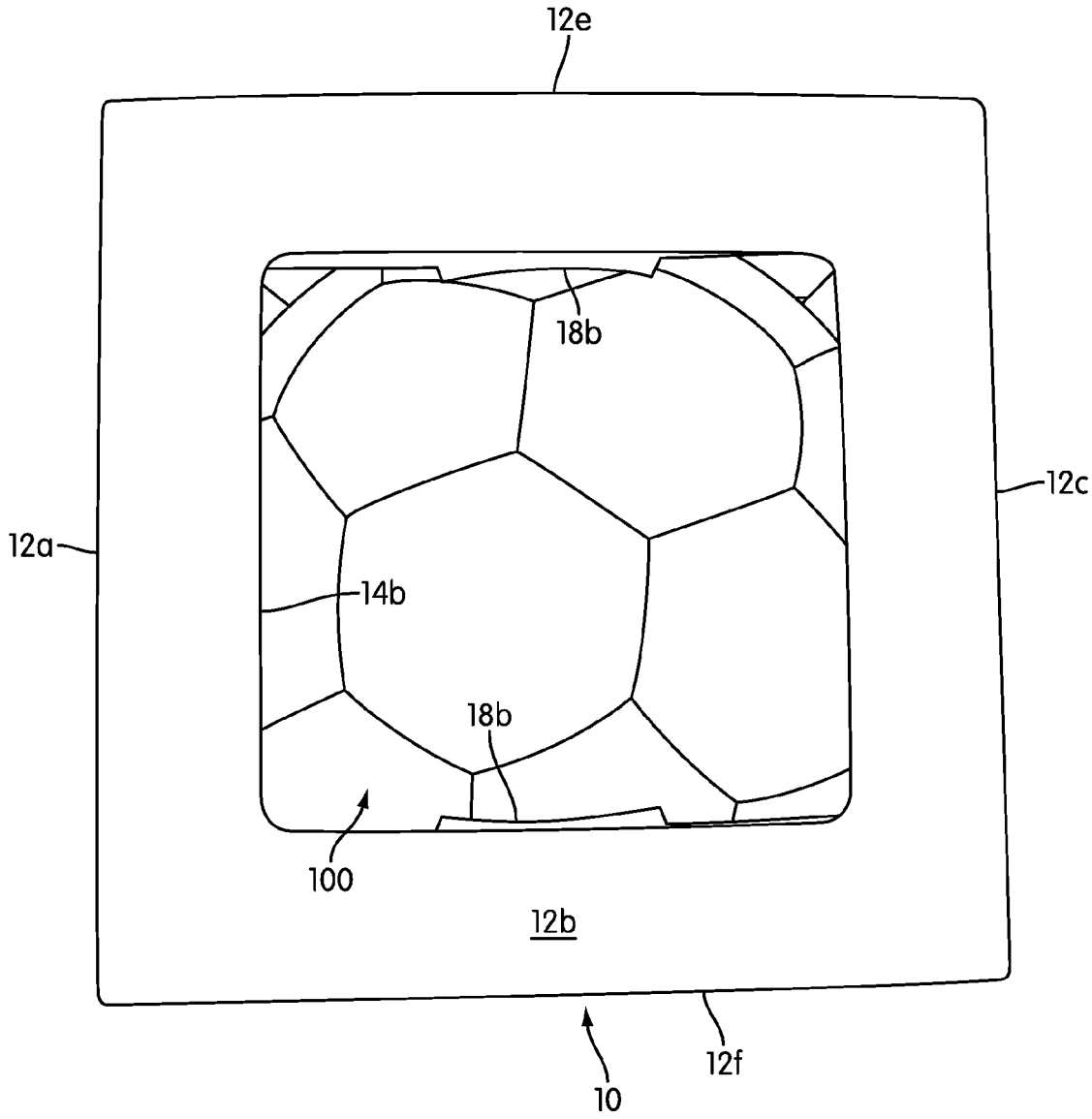
Figure 4:
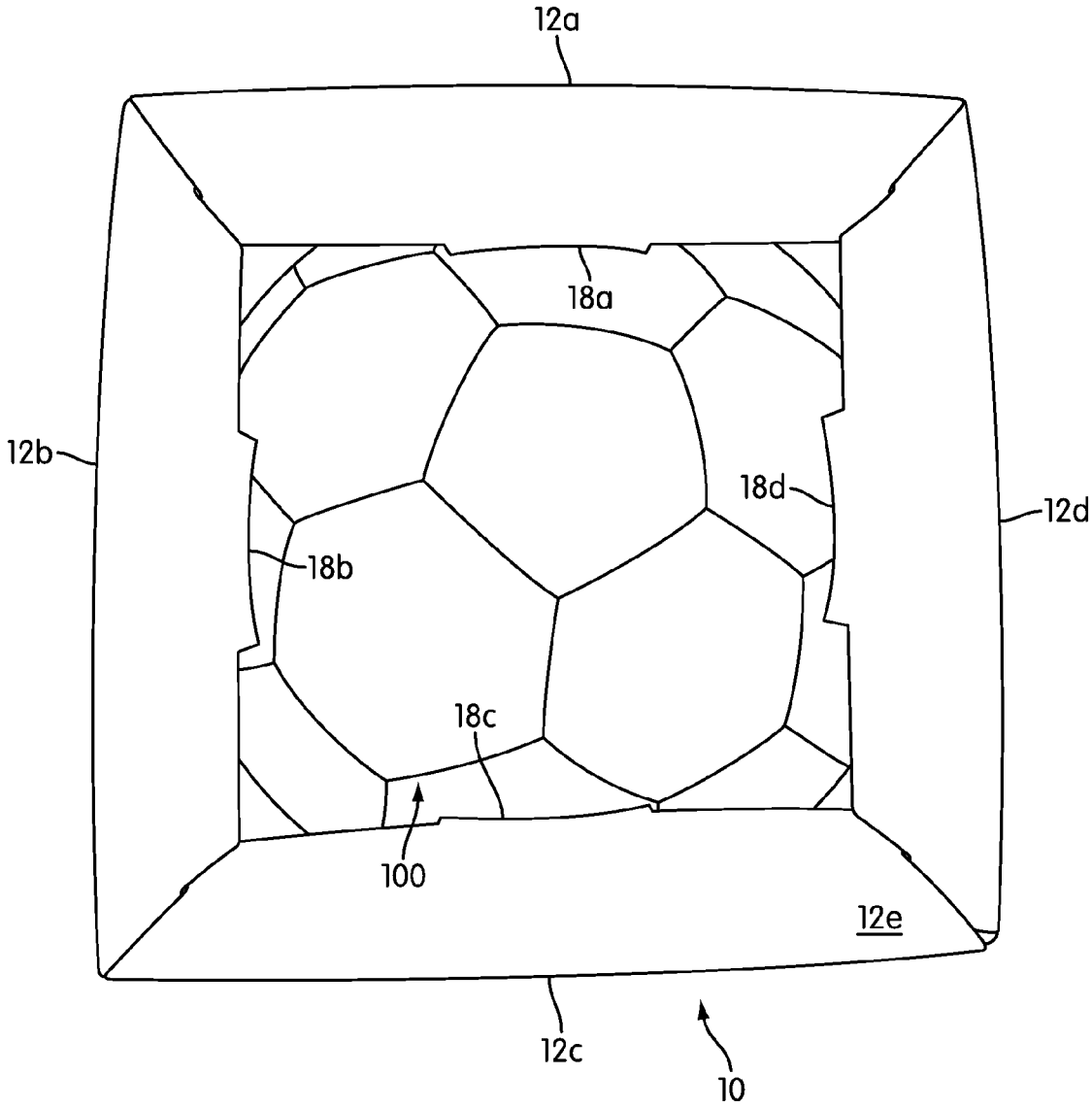
FIG. 4 is a top plan view of the first display container in the closed configuration and in combination with the game ball.
Figure 5:
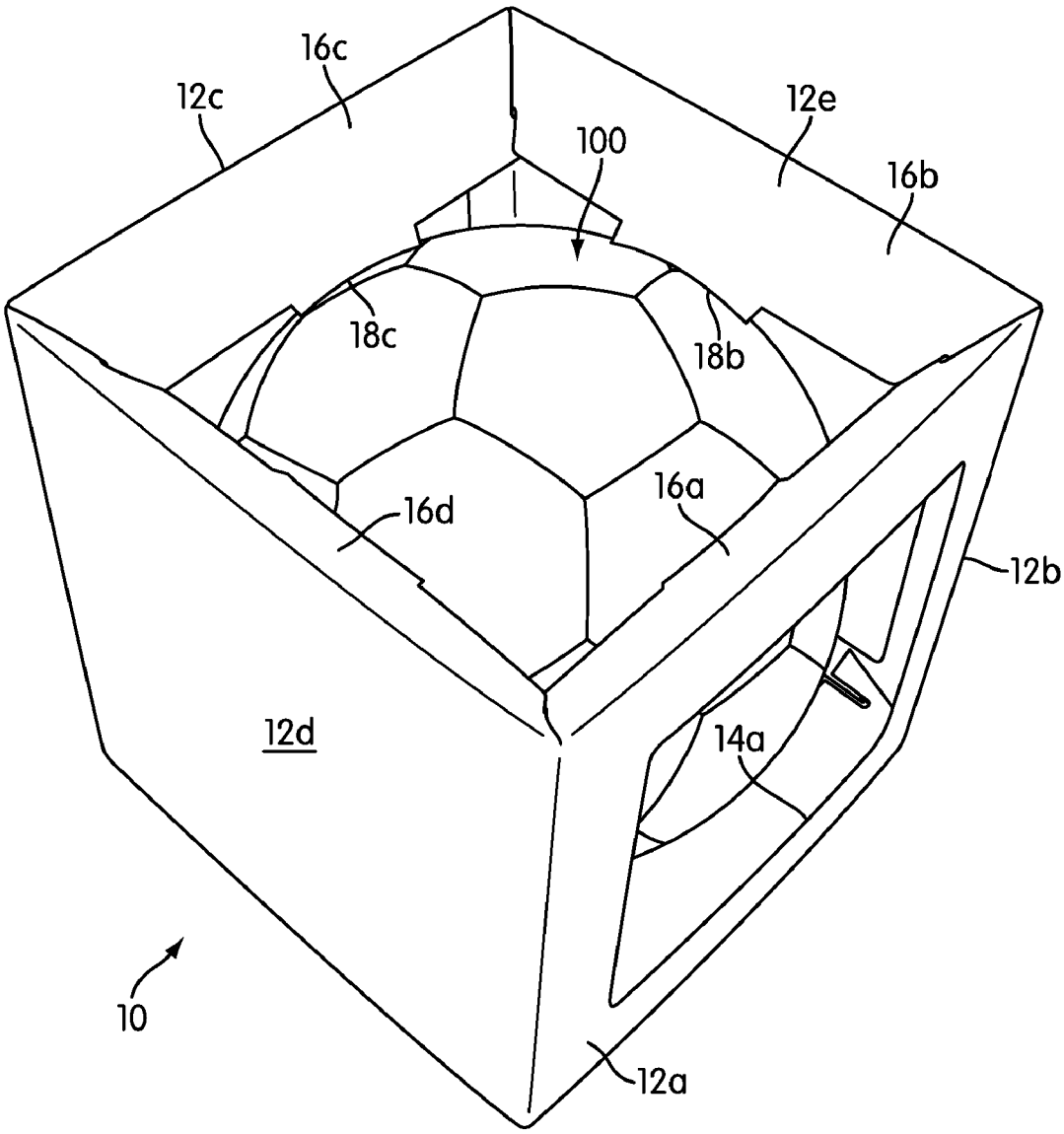
FIG. 5 is another perspective view of the first display container in the closed configuration and in combination with the game ball.
Figure 6:
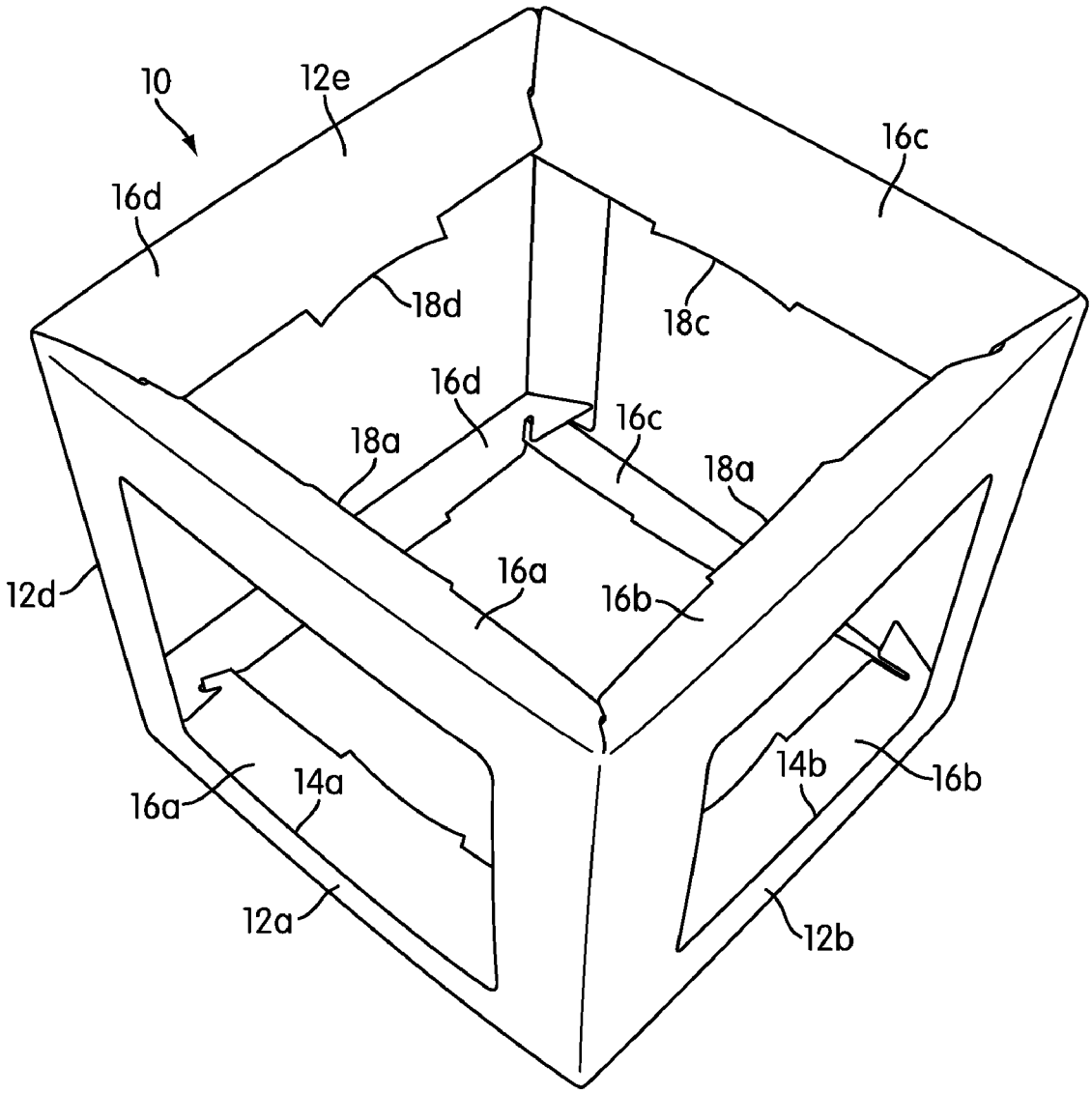
FIG. 6 is a perspective view of the first display container in the closed configuration.
Figure 7:
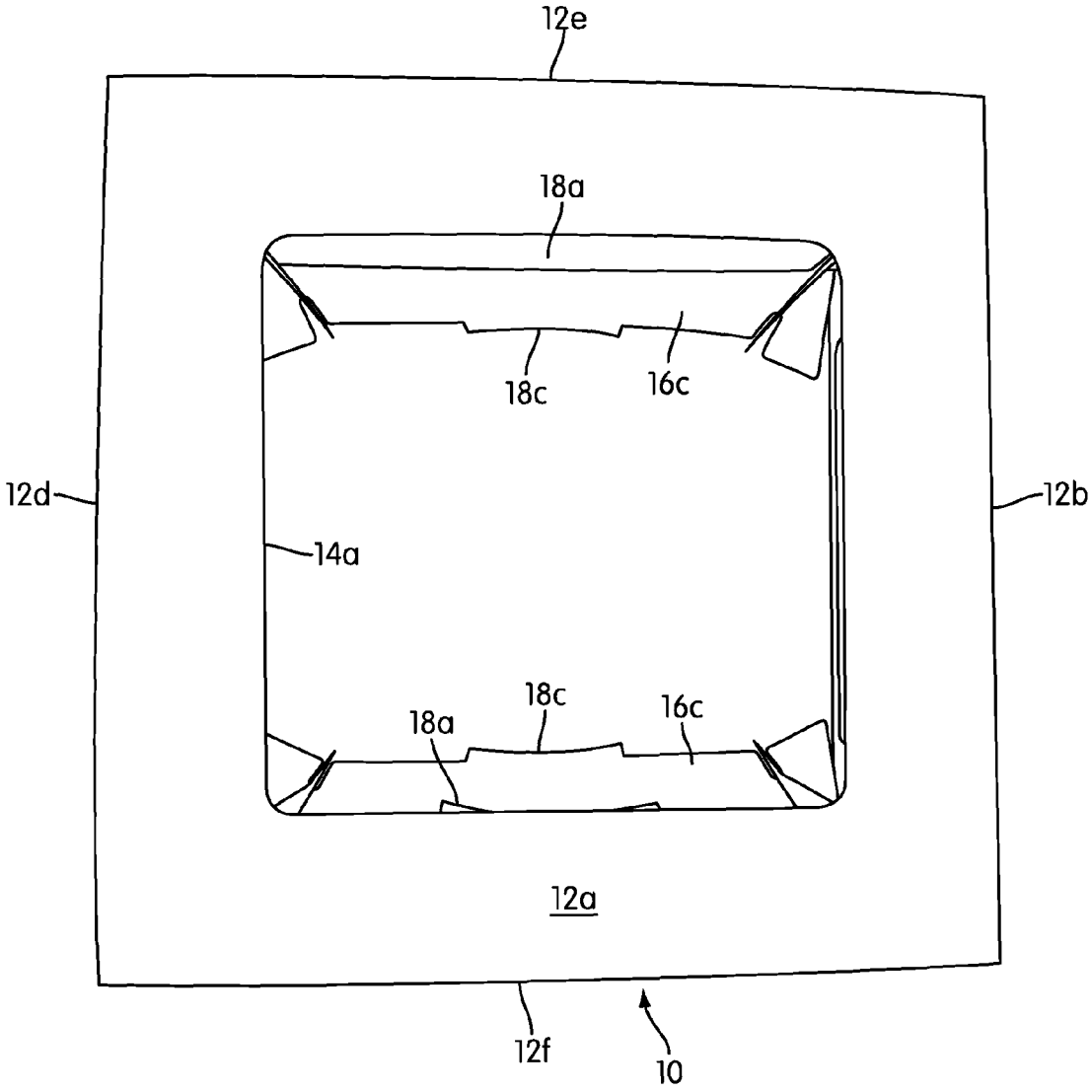
FIGS. 7 and 8 are side elevational views of the first display container in the closed configuration.
Figure 8:
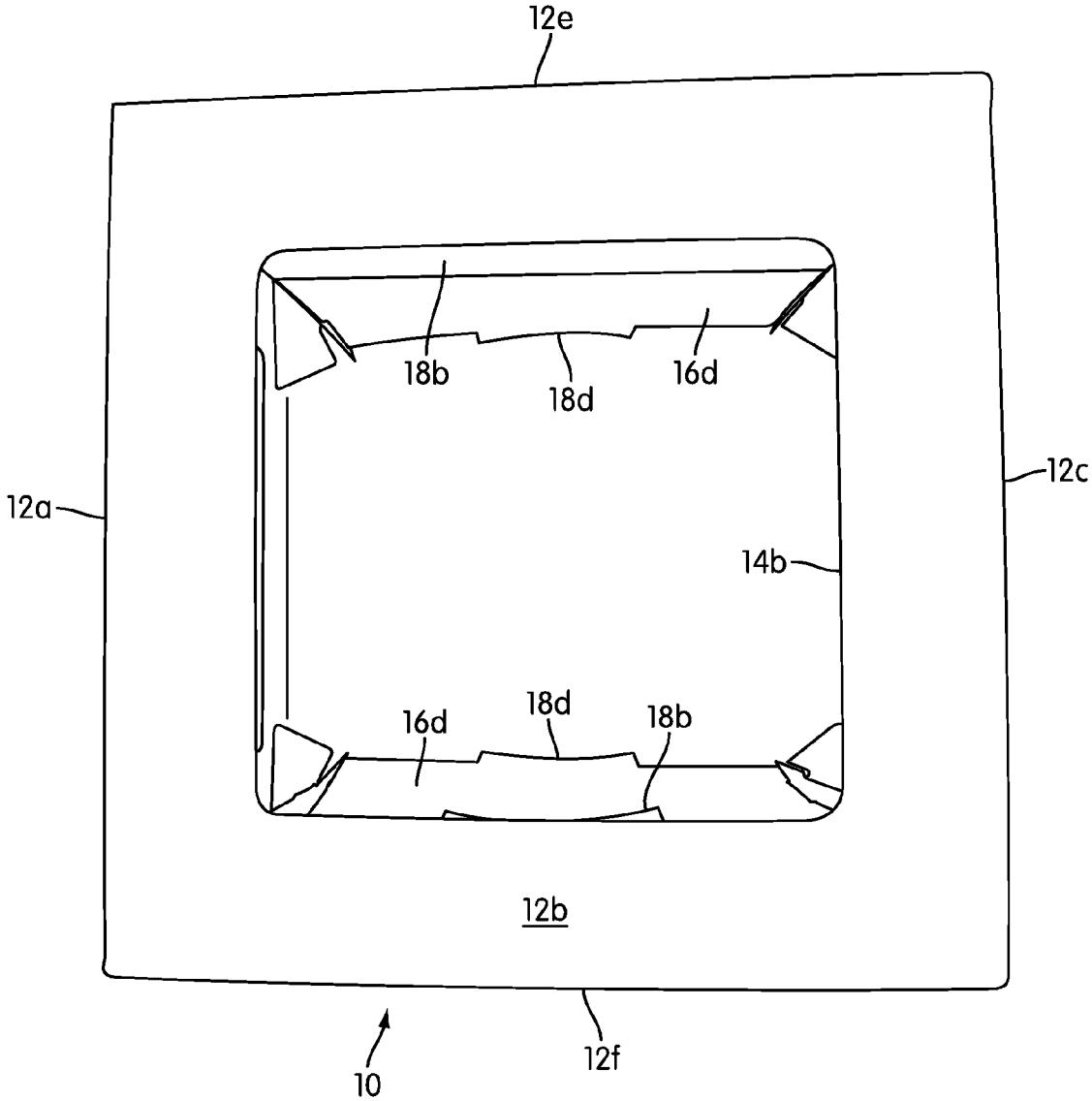
Figure 9:
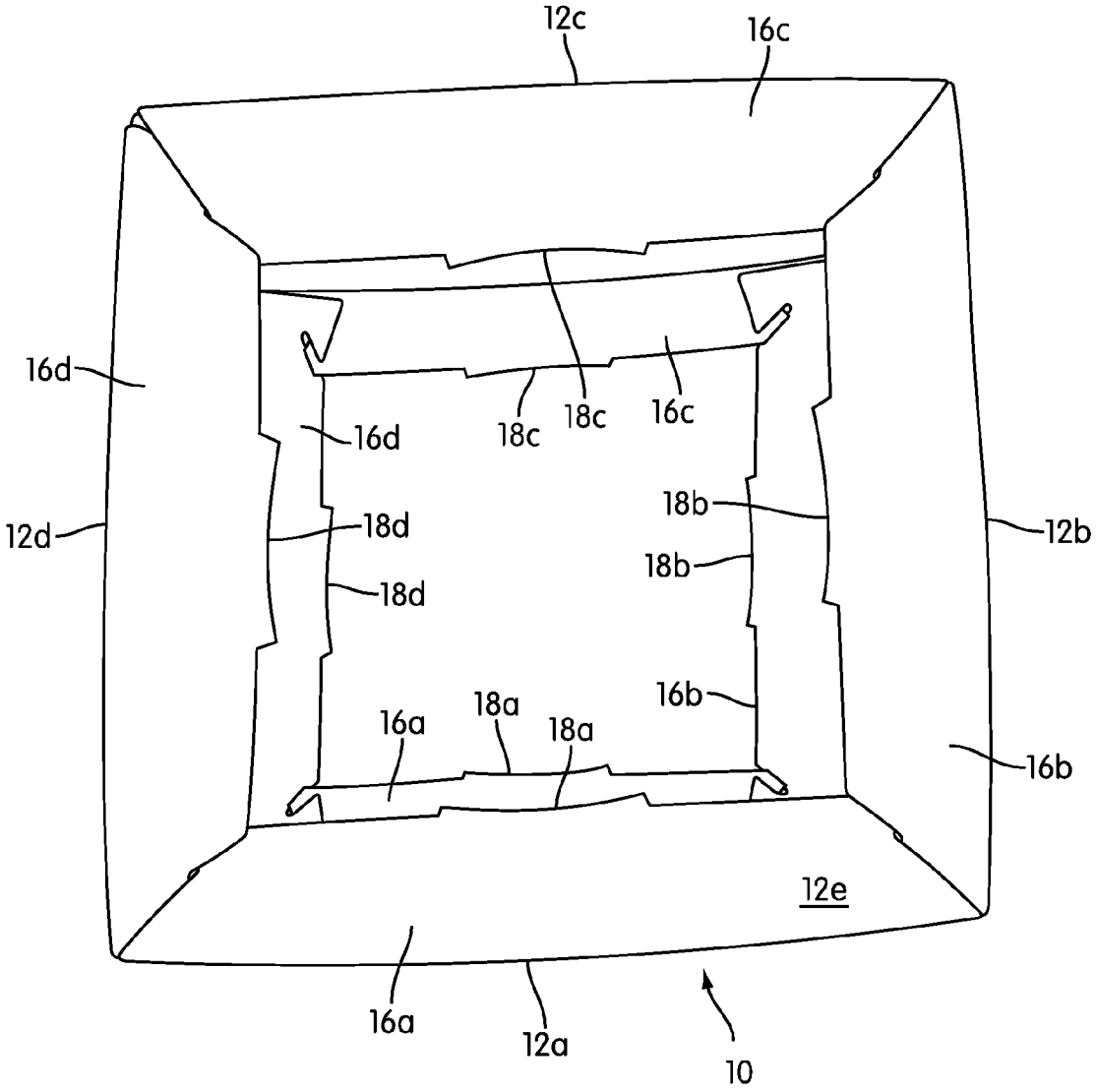
FIG. 9 is a top plan view of the first display container in the closed configuration.
Figure 10:
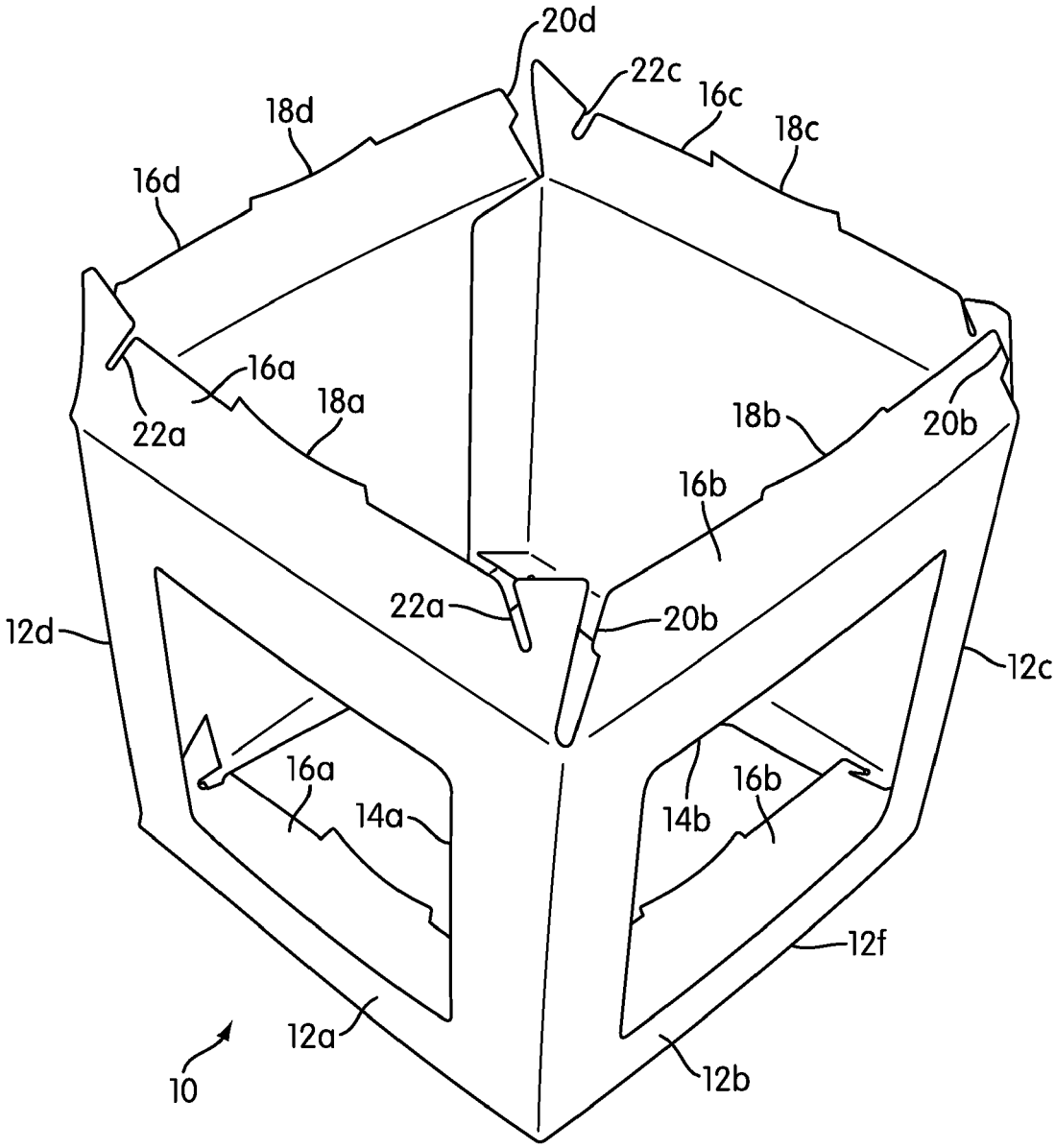
FIG. 10 is a perspective view of the first display container in an open configuration.
Figure 11:
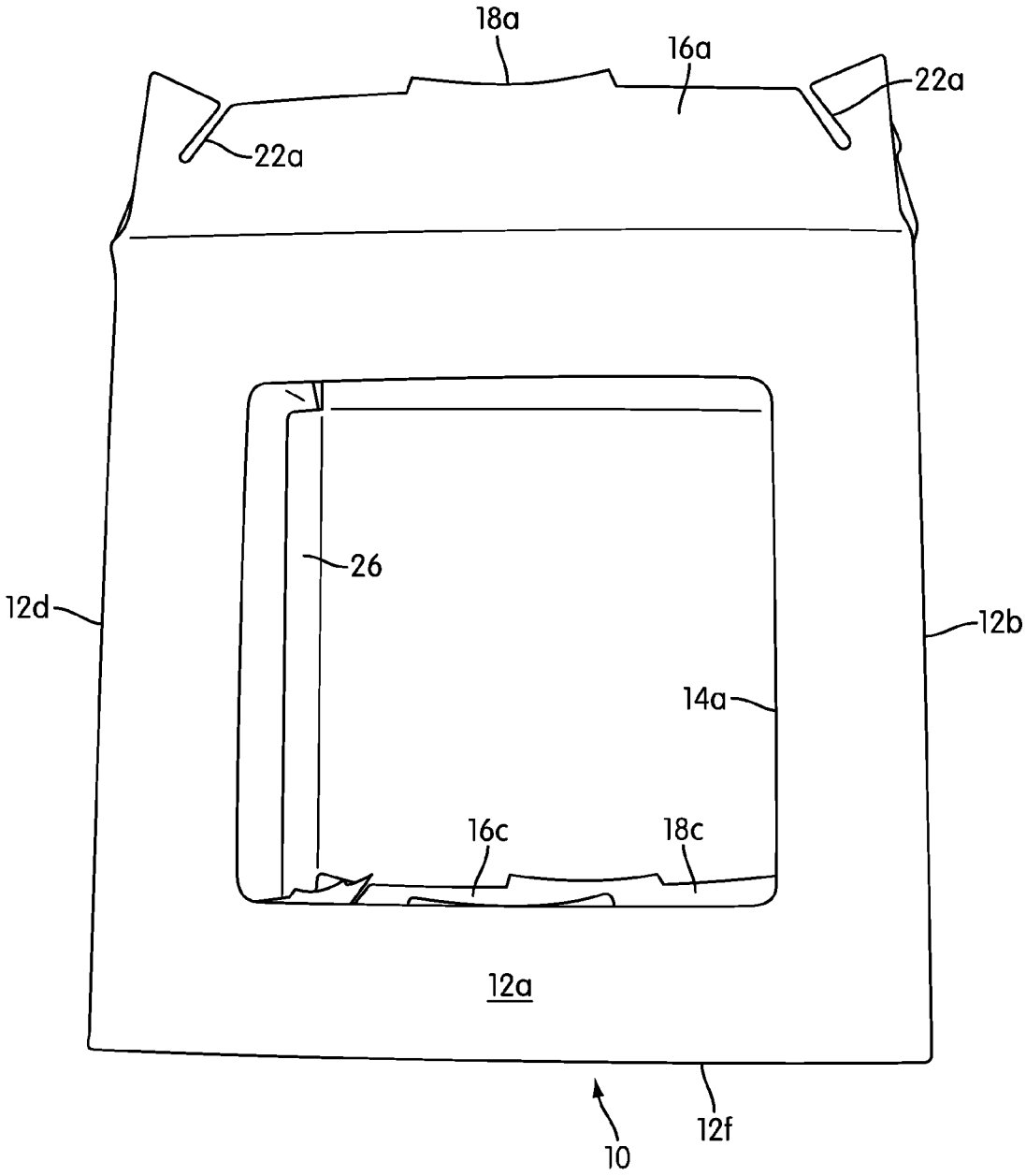
FIGS. 11 and 12 are side elevational views of the first display container in the open configuration.
Figure 12:
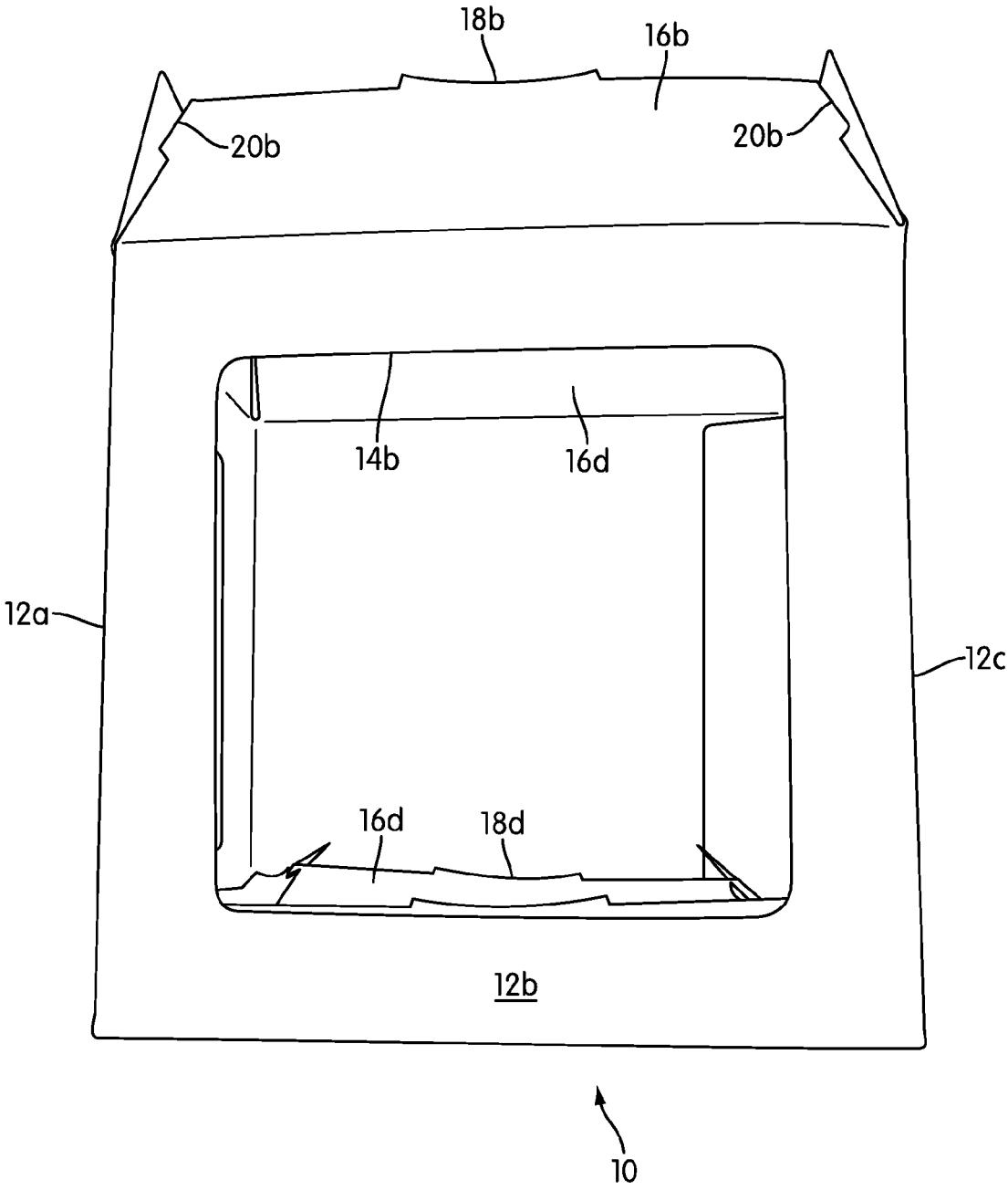
Figure 13:
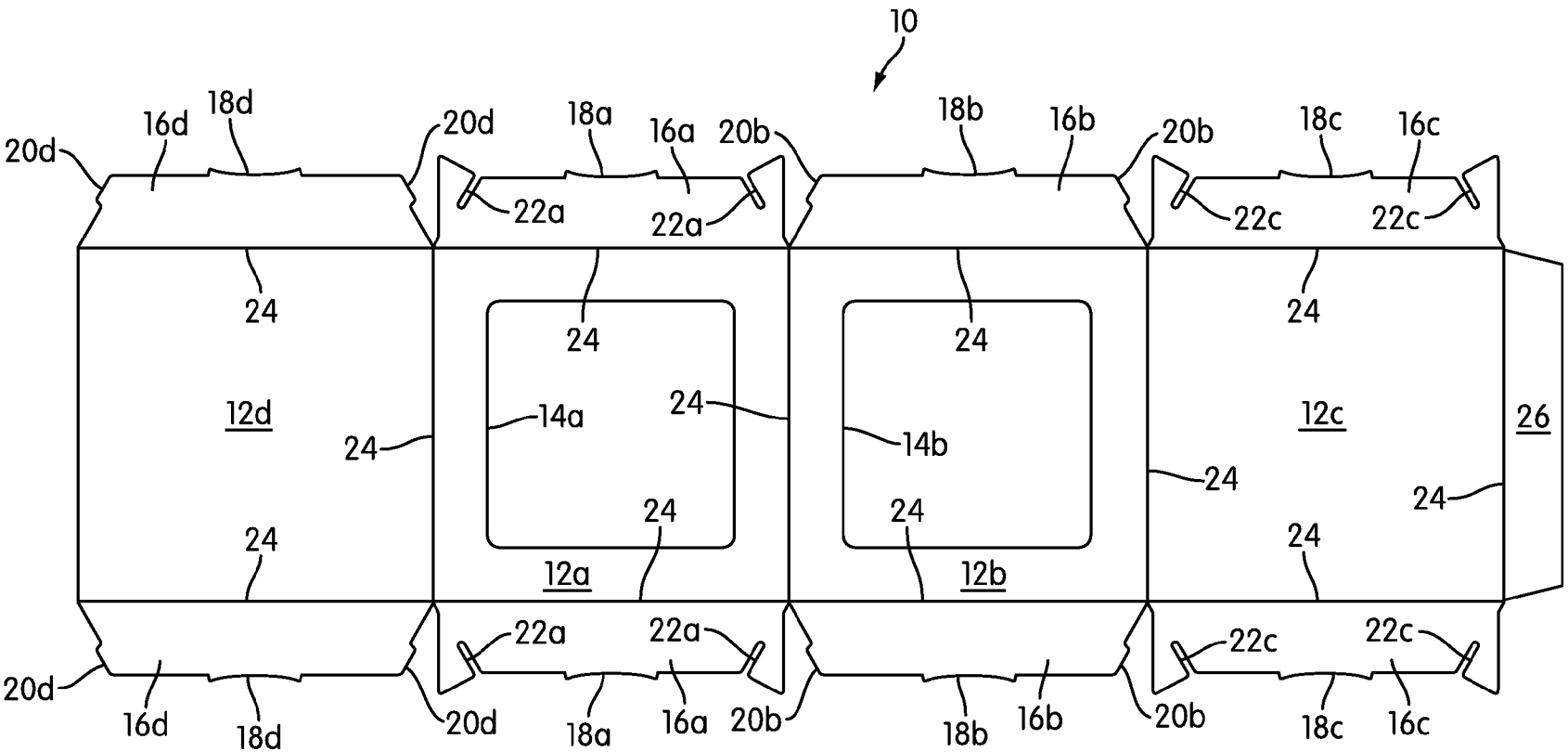
FIG. 13 is a plan view of an element that forms the first display container.
Figure 14:
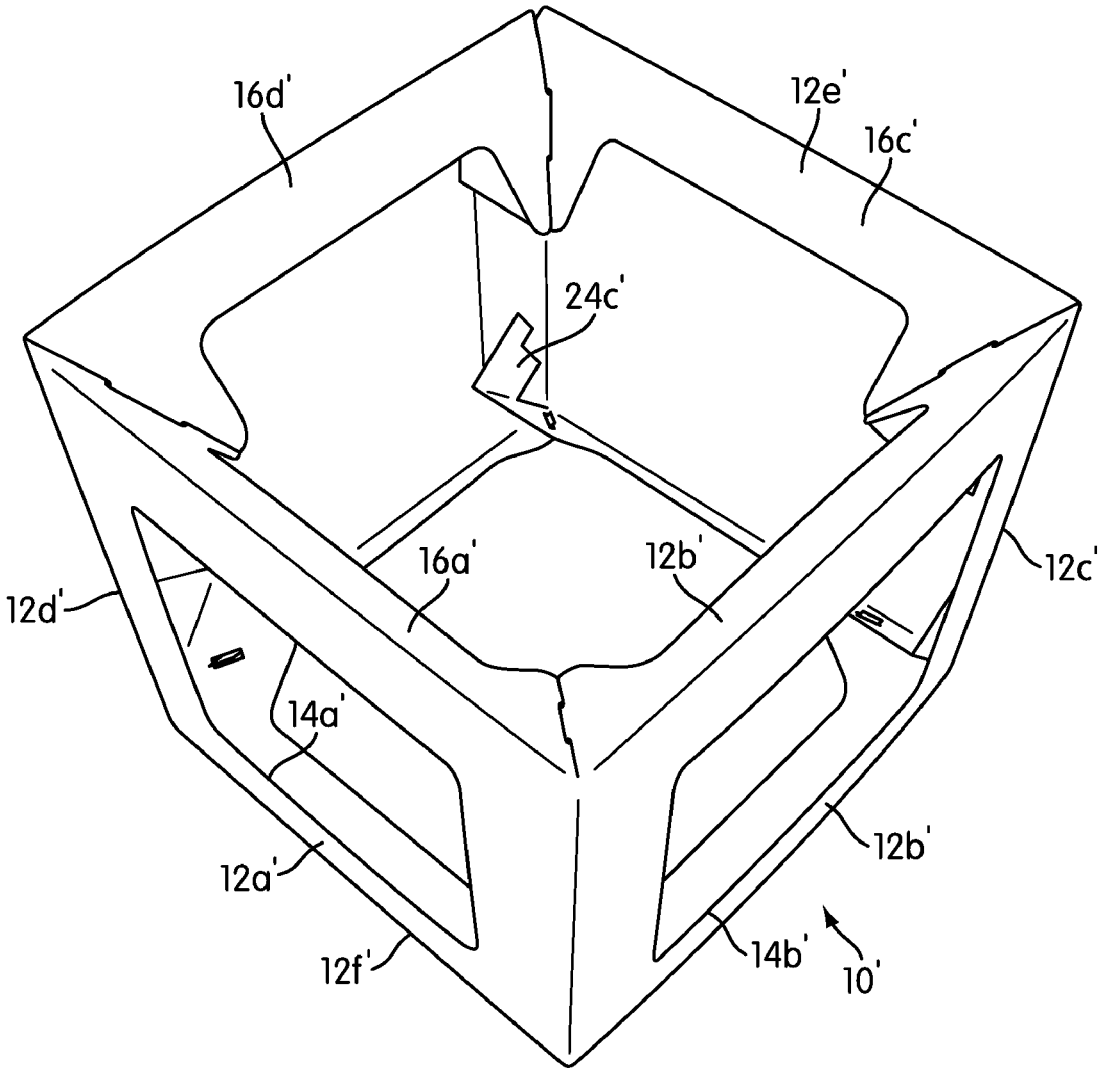
FIG. 14 is a perspective view of a second display container in a closed configuration.
Figure 15:
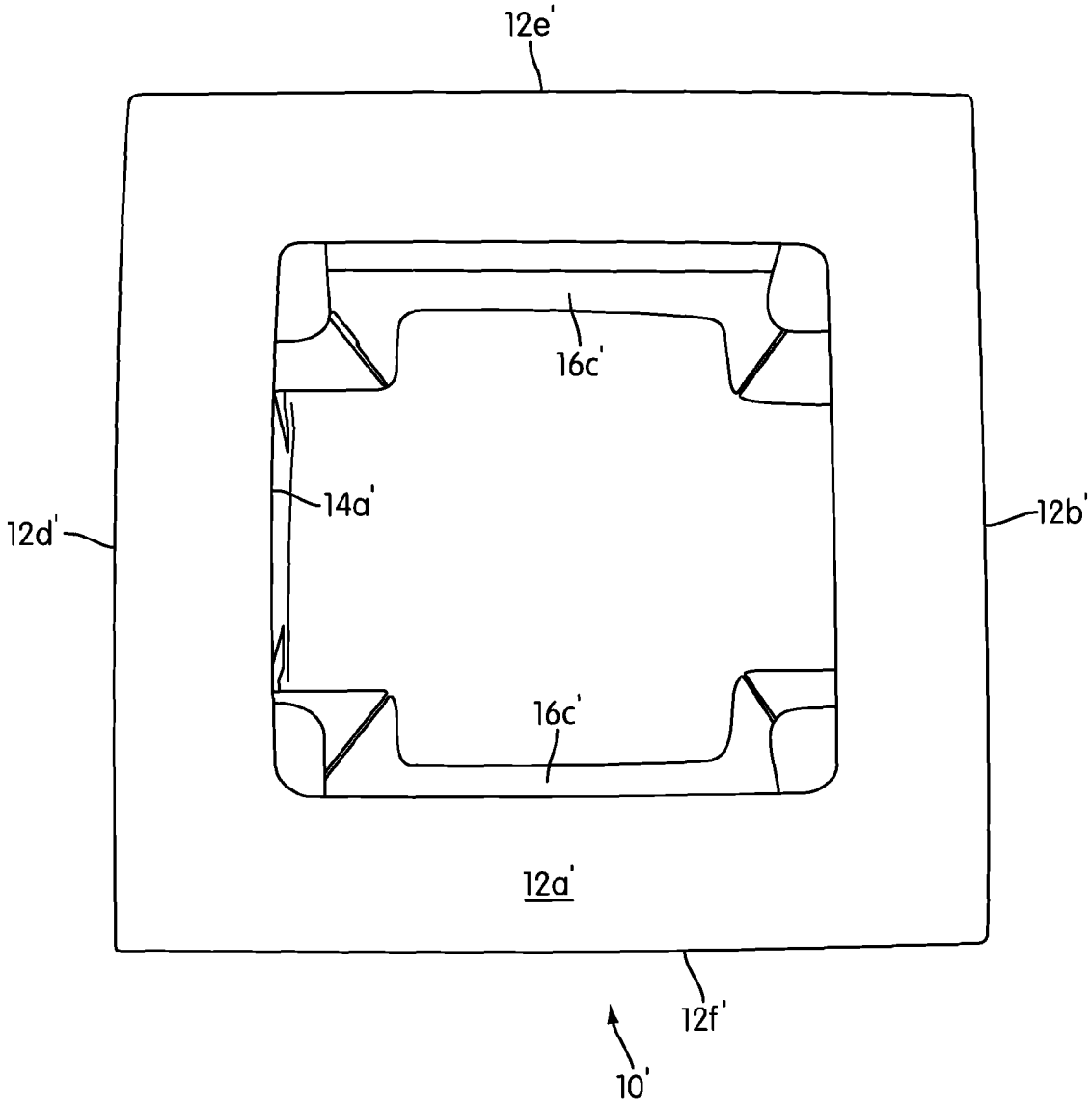
FIG. 15 is a side elevational view of the second display container in the closed configuration.
Figure 16:
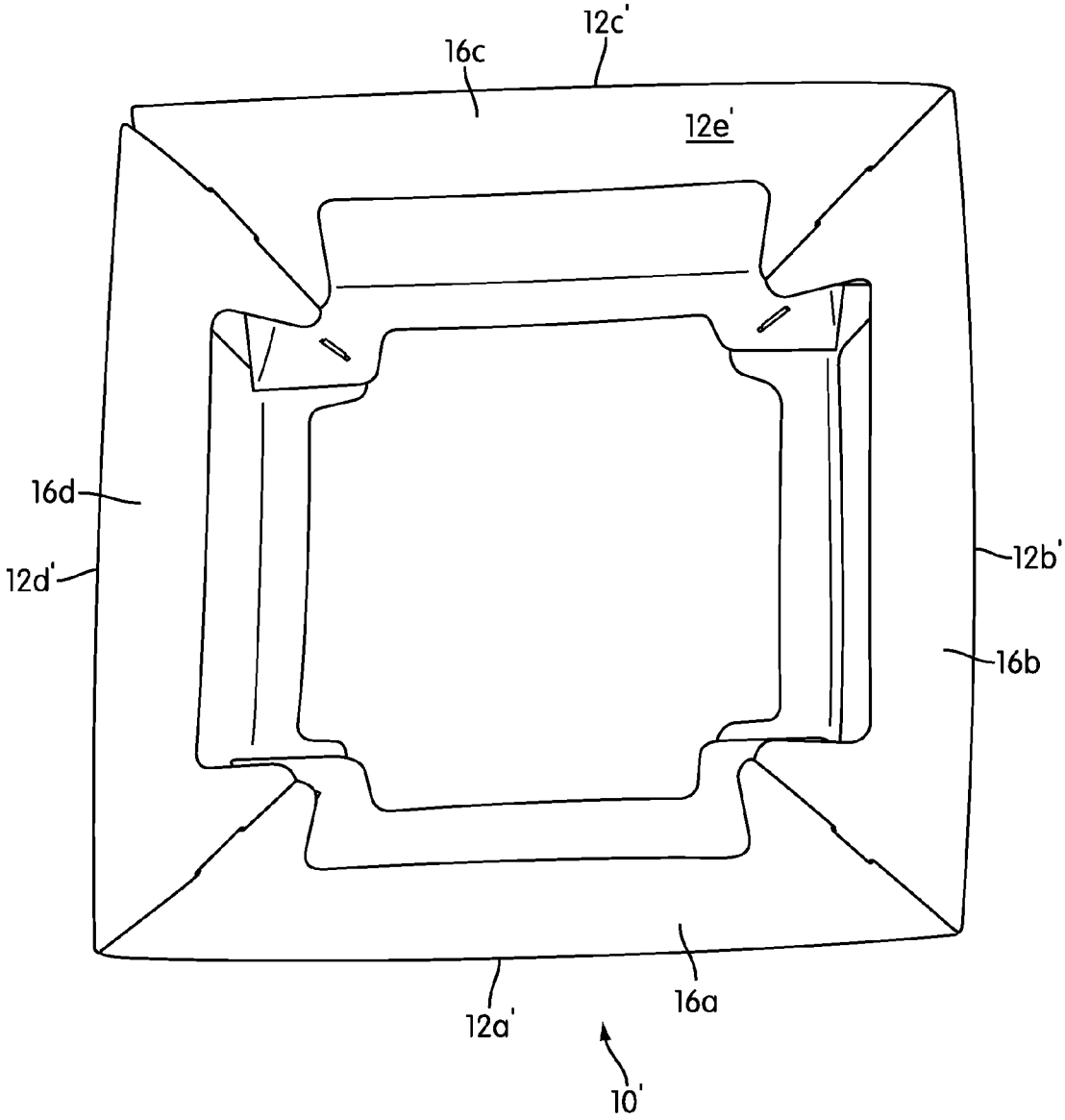
FIG. 16 is a top plan view of the second display container in the closed configuration.
Figure 17:
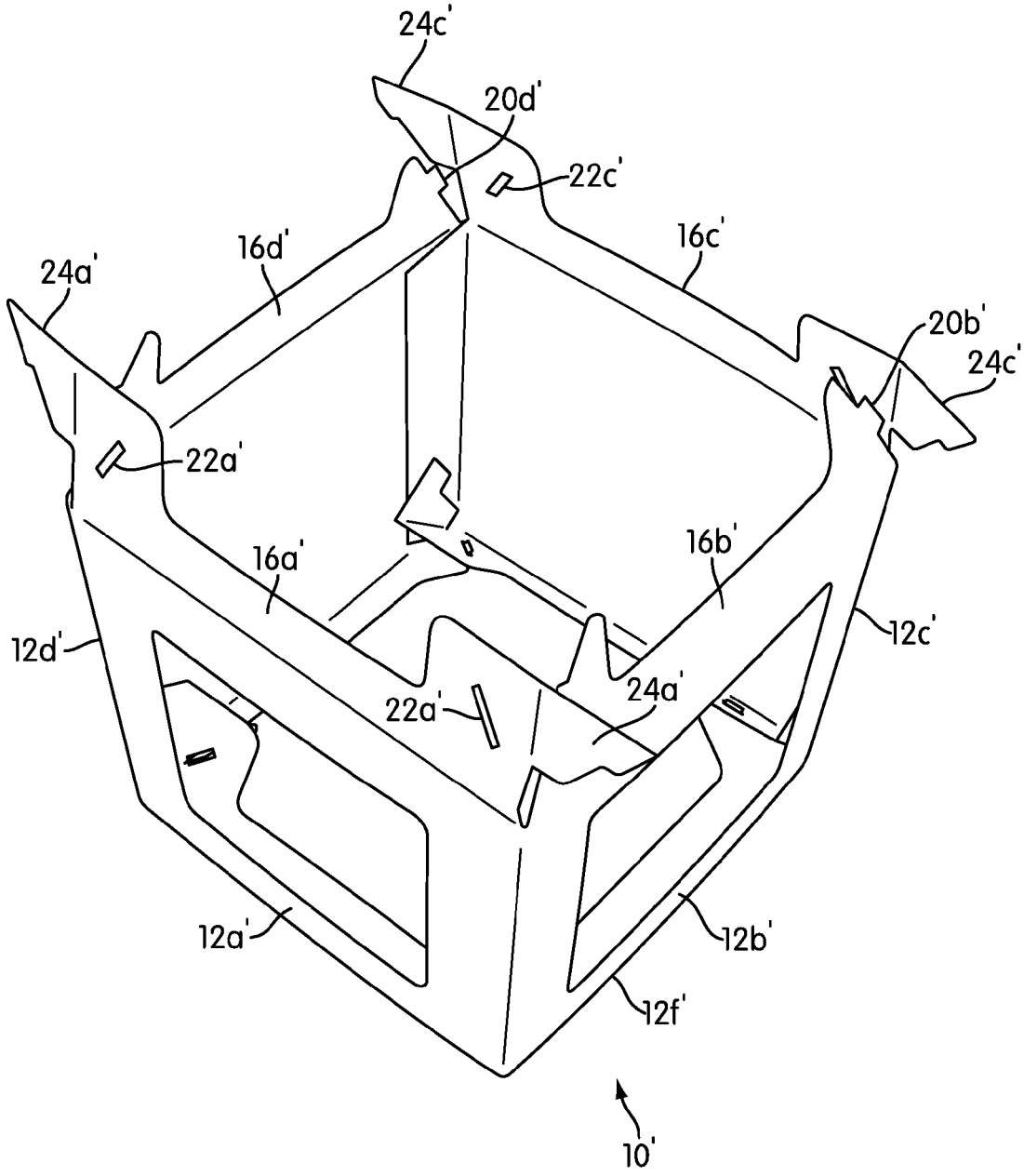
FIG. 17 is a perspective view of a second display container in an open configuration.
Figure 18:
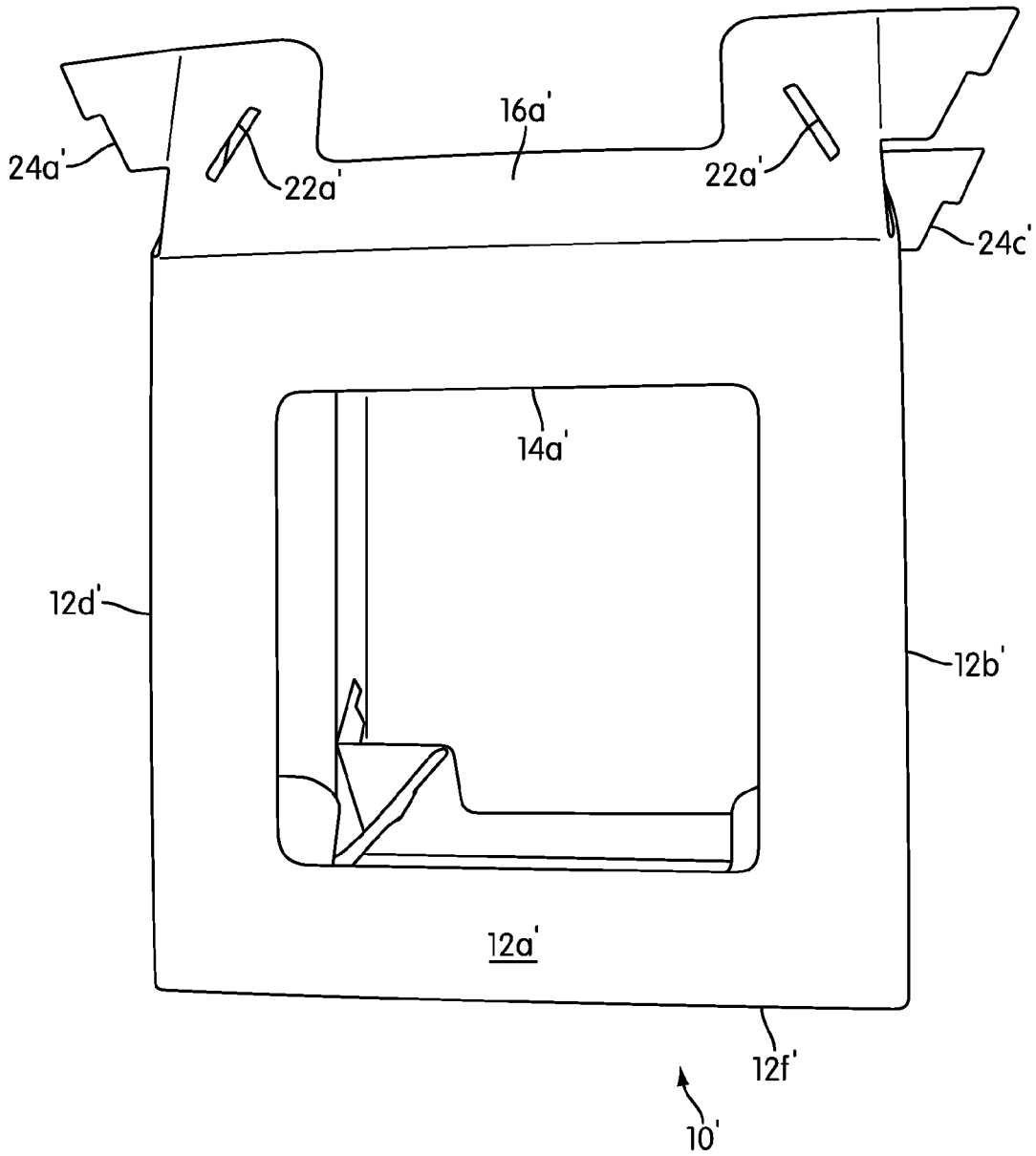
FIGS. 18 and 19 are side elevational views of the second display container in the open configuration.
Figure 19:
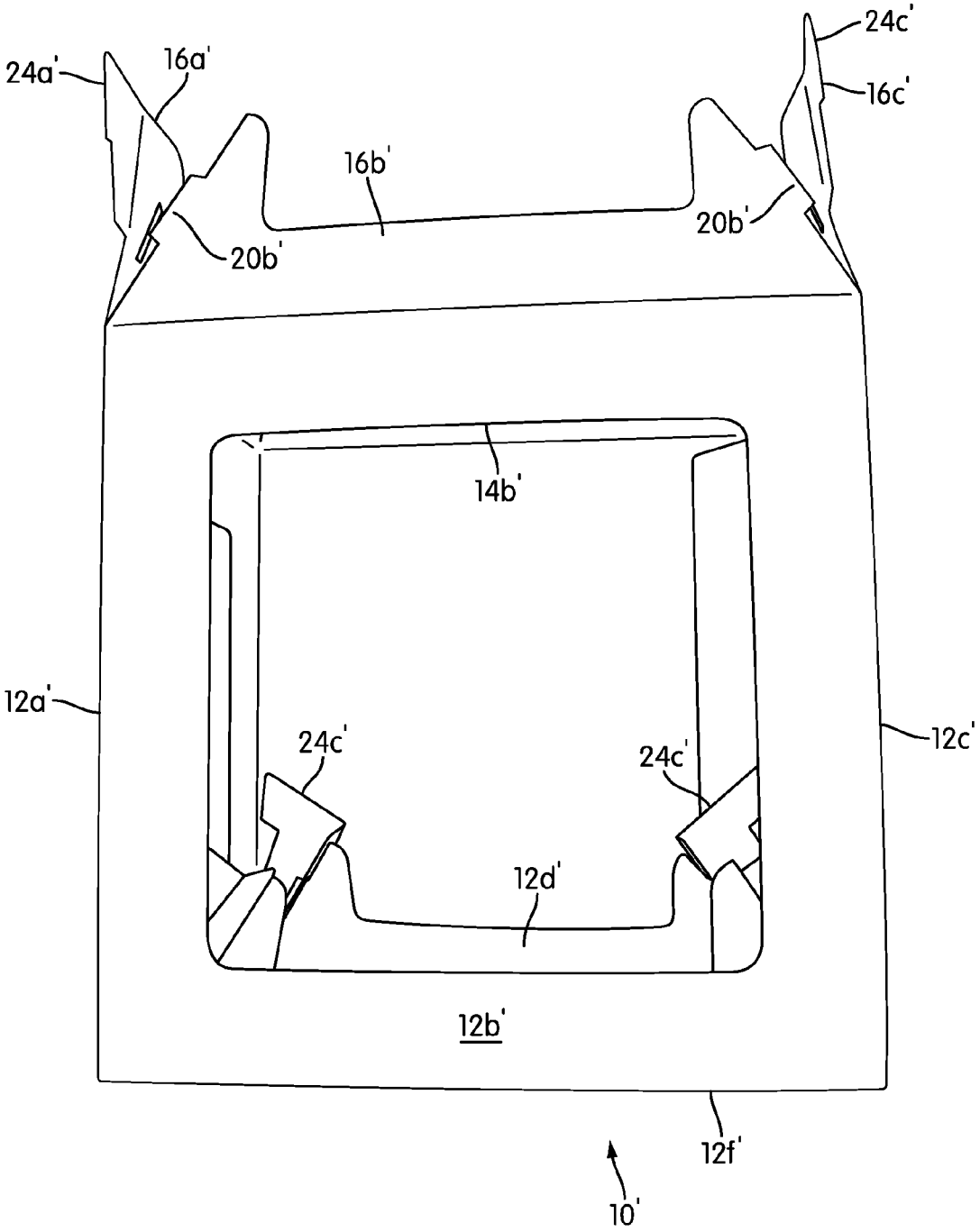

Container 10 is depicted in combination with soccerball 100 in FIGS. 1-5. FIGS. 6-9 correspond with FIGS. 1-4, but depict container 10 with soccerball 100 absent. Whereas FIGS. 1-9 depict container 10 in a closed configuration, FIGS. 10-12 depict container 10 in an open configuration, which may be utilized to place soccerball 100 within container 10 or remove soccerball 100 from container 10. In addition, FIG. 13 depicts container 10 in an unassembled configuration. That is, FIG. 13 is a plan view of an element that forms container 10. Although container 10 may be formed from a single element of material, as in FIG. 13, some configurations of container 10 may be formed from two or more joined elements. A variety of materials may be utilized for display container 10, including cardboard, paper, various polymers, or combinations of these materials, for example. Accordingly, the element depicted in FIG. 13 may be stamped or otherwise formed from a single cardboard element that is then folded and joined.

Container 10 has a generally cubic shape that defines six sides 12*a*-12*f* and an interior void bounded by sides 12*a*-12*f* for receiving soccerball 100. Sides 12*a* and 12*b* respectively define apertures 14*a* and 14*b* through which soccerball 100 is visible. Sides 12*c* and 12*d* are not depicted as having apertures, which provides areas for information regarding soccerball 100 to be printed on the exterior of container 10. In further configurations of container 10, either of apertures 14*a* and 14*b* may be absent (i.e., the material of container 10 may extend across the areas of apertures 14*a* and 14*b*) or sides 12*c* and 12*d* may also include apertures. Sides 12*e* and 12*f*, which respectively form a top and a bottom of container 10, also expose areas of soccerball 100. Accordingly, the configuration of container 10 in FIGS. 1-5 exposes soccerball 100 through four of the six sides 12*a*-12*f*.

In addition to exposing portions of soccerball 100, container 10 provides support to soccerball 100. The support is provided by various flaps 16*a*-16*d* that extend into the void in container 10 and contact soccerball 100. For example, one of flaps 16*a* extends from an upper area of side 12*a* and is angled downward to contact soccerball 100, and another of flaps 16*a* extends from a lower area of side 12*a* and is angled upward to contact soccerball 100. Similarly, one of flaps 16*b* extends from an upper area of side 12*b* and is angled downward to contact soccerball 100, and another of flaps 16*b* extends from a lower area of side 12*b* and is angled upward to contact soccerball 100. As with sides 12*a* and 12*b*, each of sides 12*c* and 12*d* respectively have two flaps 16*c* and 16*d* that are angled downward and upward to contact soccerball 100.

Each of flaps 16*a*-16*d* respectively have a protrusion 18*a*-18*d* that is approximately centered relative to sides of flaps 16*a*-16*d* and contacts soccerball 100. Protrusions 18*a*-18*d* extend outward from ends of flaps 16*a*-16*d* and have a concave configuration that contacts soccerball 100. That is, protrusions 18*a*-18*d* are shaped to have a curvature that is approximately equal to the curvature of soccerball 100. Accordingly, protrusions 18*a*-18*d* contact the surface of soccerball 100 along substantially all of the length of protrusions 18*a*-18*d*. In some configurations of container 10, protrusions 18*a*-18*d* may not be shaped to have a curvature that is approximately equal to the curvature of soccerball 100, or protrusions 18*a*-18*d* may be absent from flaps 16*a*-16*d*.

End portions of flaps 16*b* and 16*d* also respectively form a pair of other protrusions 20*b* and 20*d*. Similarly, end portions of flaps 16*a* and 16*b* respectively form a pair of slits 22*a* and 22*c*. When folded inward, protrusions 20*b* and 20*d* extend into and mate with slits 22*a* and 22*c* to interlock flaps 16*a*-16*d* with each other. Referring specifically to FIG. 10, one of protrusions 20*b* from flap 16*b* is immediately adjacent one of slits 22*a* from flap 16*a*. When flaps 16*a* and 16*b* are folded inward, protrusion 20*b* will extend into slit 22*a* to interlock flaps 16*a* and 16*b*. Similar concepts apply at other locations of container 10. Slits 22*a* and 22*c* may also have the configuration of elongate apertures in some configurations.

An element that forms container 10 is depicted in FIG. 13 and the various sides 12*a*-12*d*, apertures 14*a* and 14*b*, flaps 16*a*-16*d*, protrusions 18*a*-18*d*, protrusions 20*b* and 20*d*, and slits 22*a* and 22*c* are depicted. Note, however, that the element does not actually include specific portions that form sides 12*e* and 12*f*. When (a) the element is folded along various fold lines 24 and (b) a joining flap 26 extending from an edge of side 12*c* is adhered or otherwise joined to side 12*d*, sides 12*e* and 12*f* are defined by the upper and lower edges of sides 12*a*-12*d* (i.e., the portions of sides 12*a*-12*d* with flaps 16*a*-16*d*).

Based upon the above discussion, container 10 has a configuration suitable for receiving and displaying soccerball 100. In other configurations, container 10 may also be utilized to receive and display a variety of other types of game balls or other products. Advantages of the configuration of container 10 are that (a) consumers may inspect soccerball 100 through apertures 14*a* and 14*b* and through sides 12*e* and 12*f*, (b) sides 12*c* and 12*d* provide an area for information regarding soccerball 100 to be displayed, and (c) soccerball 100 is protected by container 10 during transport and at a retail location. Another advantage of container 10 relates to protrusions 18*a*-18*d*. As discussed, protrusions 18*a*-18*d* are shaped to have a curvature that is approximately equal to the curvature of soccerball 100, and protrusions 18*a*-18*d* contact the surface of soccerball 100 along substantially all of the length of protrusions 18*a*-18*d*. This configuration limits the degree to which soccerball 100 rotates or otherwise moves during transport. At the retail location, therefore, logos or other information printed on soccerball 100 may remain visible to the consumer if placed within container 10 such that the logos are visible. An additional advantage of container 10 relates to the interaction between protrusions 20*b* and 20*d* and slits 22*a* and 22*c*. When folded inward, protrusions 20*b* and 20*d* extend into and mate with slits 22*a* and 22*c* to interlock flaps 16*a*-16*d* with each other. In this configuration, flaps 16*a*-16*d* may be merely folded inward to interlock flaps 16*a*-16*d* and complete the assembly of container 10. That is, this configuration provides a relatively easy manner of securing soccerball 100 within container 10.

Another configuration is depicted in FIGS. 14-19 as container 10'. As with container 10, container 10' is suitable for receiving soccerball 100, other game balls, or a variety of other products. The primary elements of container 10' are various sides 12*a*'-12*f*', a pair of apertures 14*a*' and 14*b*', and eight flaps 16*a*'-16*d*'. Flaps 16*a*' and 16*c*' include various slits 22*a*' and 22*c*' that extend into various protrusions 20*b*' and 20*d*' on flaps 16*b*' and 16*d*' to interlock flaps 16*a*'-16*d*' with each other. Flaps 16*a*' and 16*c*' also include various wings 24*a*' and 24*c*' that fold inward to provide additional support for flaps 16*a*'-16*d*'. In one or more configurations, wings 24*a*'-*d*' may extend longitudinally past the sides of container 10'. The longitudinal edges/sides of flaps 16*b*' and 16*d*' may further be sloped to facilitate joining with flaps 16*a*' and 16*c*'. Wings 24*a*'-24*d*' may further extend in a lateral direction past a lateral edge of a remainder of flaps 16*a*' and 16*c*'. Similarly, the longitudinal ends of flaps 16*b*' and 16*d*' may also protrude from the remainder of flaps 16*b*' and 16*d*' in a lateral direction. Each of wings 24*a*'-24*d*' may further include a crease between a portion extending beyond a side of container 10' and the remainder of the wing. Additionally or alternatively, a longitudinal edge of each wing of wings 24*a*'-24*d*' may be angled or sloped.

Figure 20:
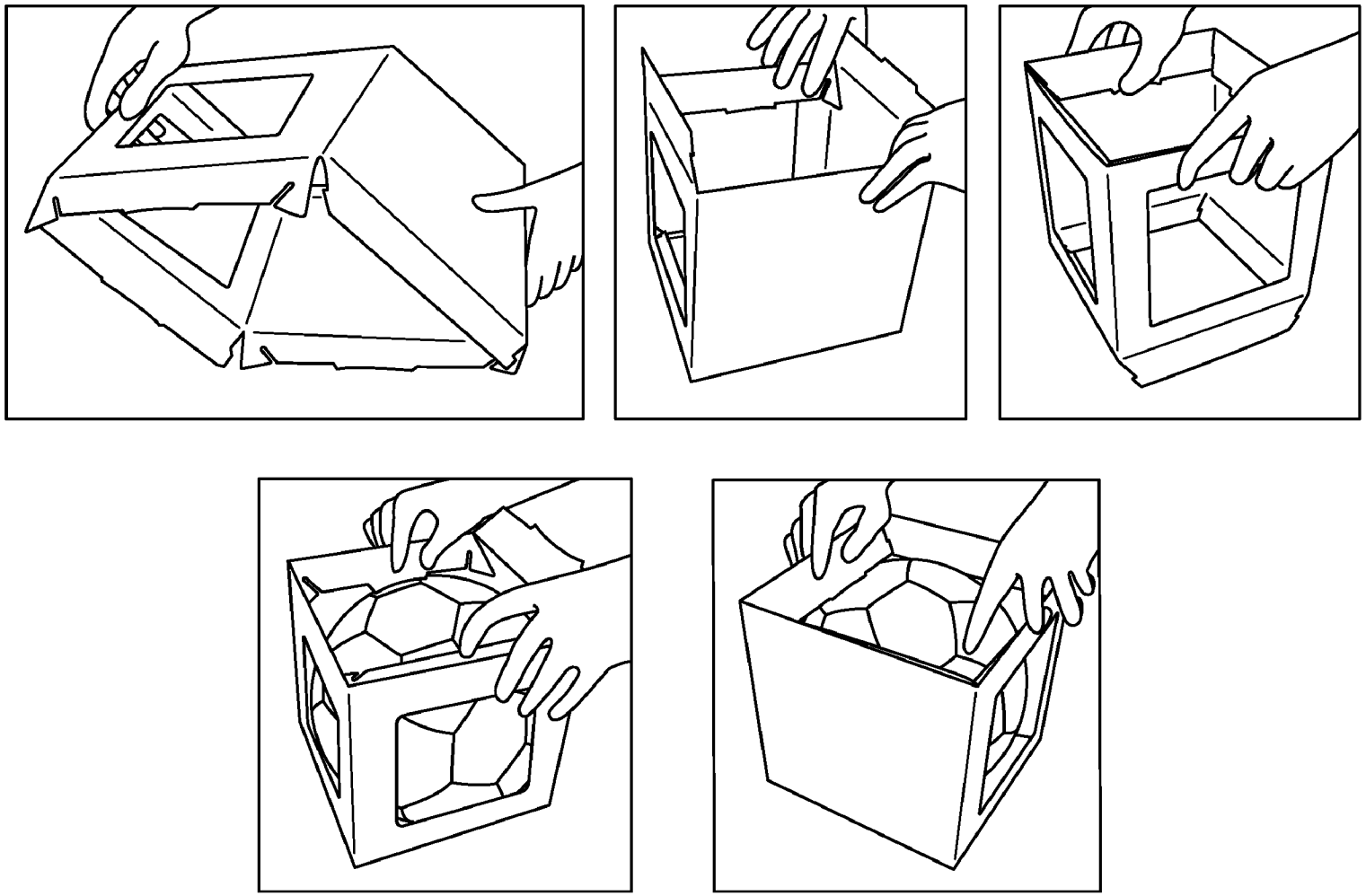
FIG. 20 illustrates a process for assembling the first display container.

With reference to FIG. 20, a method of assembling container 10 is depicted. Initially, the element depicted in FIG. 13 is folded between sides 12*a*-12*d* such that joining flap 26 contacts side 12*d*, where joining flap 26 is adhered. Flaps 16*a*-16*d* adjacent side 12*f* are then folded inward so that protrusions 20*b* and 20*d* enter slits 22*a* and 22*c*. Soccerball 100 may then be placed within container 10 through side 12*e*, and flaps 16*a*-16*d* adjacent side 12*e* are then folded inward so that protrusions 20*b* and 20*d* enter slits 22*a* and 22*c*. As an alternative, soccerball 100 may be placed within container 10 through the side 12*e* after flaps 16*a*-16*d* adjacent side 12*e* are folded inward. This procedure secures soccerball 100 within container 10.

In order to remove soccerball 100 from container 10, two of flaps 16*a*-16*d* may be pressed downward. By pressing two of flaps 16*a*-16*d* further inward, protrusions 20*b* and 20*d* are disengaged from slits 22*a* and 22*c* and each of flaps 16*a*-16*d* respectively extend adjacent to sides 12*a*-12*d*, thereby opening side 12*e* sufficiently for removal of soccerball 100. Accordingly, the relatively easy action of pressing downward on two of flaps 16*a*-16*d* is sufficient to remove soccerball 100 from container 10.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined herein.

We claim:

1. A structure configurable to form a container comprising:

a first panel including a first flap having a wing extending from a first longitudinal end of the first flap and wherein the first longitudinal end includes an enclosed slot configured to receive a portion of a second flap and wherein a second longitudinal end of the first flap includes a second enclosed slot configured to receive a portion of a third flap;

a second panel including the second flap, wherein the second flap includes a first protrusion configured for insertion into the enclosed slot of the first flap;

a third panel including the third flap, wherein the third flap includes a second protrusion configured for insertion into the second enclosed slot of the first flap, and wherein the first flap, the second flap and the third flap are configured to form a side of the structure, the side having an aperture through which a contained product is visible, wherein when the second flap is inserted into the enclosed slot, the wing extends from a corner defined by the first panel and the second panel inward toward the interior of the container and the wing is configured to contact the contained product.

2. The structure of claim 1, wherein a longitudinal end of the second flap is sloped.

3. The structure of claim 2, wherein the longitudinal end of the second flap protrudes laterally from a remainder of the second flap.

4. The structure of claim 1, wherein the first panel includes a first surface having a second aperture and the second panel includes a second surface void of apertures.

5. The structure of claim 1, wherein the wing of the first flap is configured to flex inward toward an interior of the container.

6. The structure of claim 1, wherein the first panel includes at least two flaps, and each of the at least two flaps includes at least two wings.

7. The structure of claim 6, wherein a first wing and a second wing of the first flap extend longitudinally from the first flap in opposite directions.

8. A display structure comprising:

a first plurality of flaps configured to form a first side of the display structure, wherein each of the first plurality of flaps configured to form the first side includes a protrusion extending from a lateral edge of the flap, wherein the protrusion is configured to contact a product contained within the display structure and wherein the first side includes an aperture through which the product is visible;

wherein the first plurality of flaps includes a first flap, the first flap including a second protrusion extending longitudinally from a longitudinal edge of the first flap; and wherein the first plurality of flaps further includes a second flap, the second flap including a slit in a first longitudinal end portion of the second flap, the slit configured to receive the second protrusion of the first flap;

a second plurality of flaps configured to form a second side of the display structure that is opposite to the first side, each flap in the second plurality of flaps includes a contact protrusion extending from a lateral edge of the flap, the contact protrusion configured to contact a product contained within the display structure and wherein the second side includes a second side aperture through which the product is visible;

wherein the second plurality of flaps includes a third flap, the third flap including a third protrusion extending longitudinally from a longitudinal edge of the third flap; and wherein the second plurality of flaps further includes a fourth flap, the fourth flap including a slit in a longitudinal end portion of the fourth flap, the slit configured to receive the third protrusion of the third flap.

* * * * *